US007599646B2

(12) United States Patent
Matayoshi

(10) Patent No.: US 7,599,646 B2
(45) Date of Patent: Oct. 6, 2009

(54) IMAGE FORMING APPARATUS WITH AN ENDLESS BELT FOR RECEIVING TONER IMAGES AND A CONTROLLER FOR CONTROLLING SURFACE SPEED OF AN IMAGE BEARING MEMBER OR THE MOVING SPEED OF THE ENDLESS BELT IN ACCORDANCE WITH SURFACE CONDITIONS OF THE ENDLESS BELT

(75) Inventor: Akira Matayoshi, Osaka (JP)

(73) Assignee: Kyocera Mita Corporation (JP)

( * ) Notice: Subject to any disclaimer, the term of this patent is extended or adjusted under 35 U.S.C. 154(b) by 176 days.

(21) Appl. No.: 11/657,903

(22) Filed: Jan. 25, 2007

(65) Prior Publication Data

US 2007/0172258 A1 Jul. 26, 2007

(30) Foreign Application Priority Data

Jan. 26, 2006 (JP) ..... 2006-017622

(51) Int. Cl.
*G03G 15/00* (2006.01)
*G03G 21/00* (2006.01)

(52) U.S. Cl. ..... 399/167; 399/24; 399/49; 399/302

(58) Field of Classification Search ..... 399/167, 399/24, 38, 49, 302, 308
See application file for complete search history.

(56) References Cited

U.S. PATENT DOCUMENTS

2004/0156653 A1* 8/2004 Takehara ..... 399/167

(Continued)

FOREIGN PATENT DOCUMENTS

JP 7-19081 B2 3/1995
JP 2003-036012 A * 2/2003

(Continued)

OTHER PUBLICATIONS

Machine translation of JP 2003-036012 A dated Sep. 11, 2008.*

(Continued)

*Primary Examiner*—Sophia S Chen
(74) *Attorney, Agent, or Firm*—Gerald E. Hespos; Anthony J. Casella

(57) ABSTRACT

An image forming apparatus includes an image forming section for forming a plurality of toner images on a plurality of image bearing members respectively by an electrographic system; an endless belt to which the plurality of toner images are to be superimposedly transferred from the plurality of image bearing members, the endless belt being arranged close to the image forming section; a driving roller which the endless belt is placed on and is adapted to drive the endless belt; a driven roller which the endless belt is placed on; a detector for detecting a surface condition of the endless belt; and a controller for controlling at least one of the surface speed of the image bearing member and the moving speed of the endless belt in accordance with an output from the detector.

10 Claims, 4 Drawing Sheets

U.S. PATENT DOCUMENTS

| | | | | |
|---|---|---|---|---|
| 2005/0036797 | A1 * | 2/2005 | Miura | 399/44 |
| 2005/0141920 | A1 * | 6/2005 | Sato et al. | 399/167 |
| 2005/0271429 | A1 | 12/2005 | Tachibana et al. | |
| 2006/0120740 | A1 * | 6/2006 | Yamada et al. | 399/49 |

FOREIGN PATENT DOCUMENTS

| | | | |
|---|---|---|---|
| JP | 2003-241472 | | 8/2003 |
| JP | 2003-302878 | | 10/2003 |
| JP | 2005-070592 | A * | 3/2005 |

OTHER PUBLICATIONS

Machine translation of JP 2003-241472 A dated Sep. 11, 2008.*
Machine translation of JP 2003-302878 A dated Sep. 11, 2008.*
Machine translation of JP 2005-070592 A dated Sep. 11, 2008.*

* cited by examiner

IMAGE FORMING APPARATUS WITH AN ENDLESS BELT FOR RECEIVING TONER IMAGES AND A CONTROLLER FOR CONTROLLING SURFACE SPEED OF AN IMAGE BEARING MEMBER OR THE MOVING SPEED OF THE ENDLESS BELT IN ACCORDANCE WITH SURFACE CONDITIONS OF THE ENDLESS BELT

BACKGROUND OF THE INVENTION

1. Field of the Invention

The present invention relates to an image forming apparatus, such as a copying machine, a facsimile machine, a printer or the like.

2. Description of the Related Art

In an image forming apparatus, such as a copying machine or a printer, using an electrophotographic system, a photoconductive drum is generally used as an image bearing member. A general image forming process using a photoconductive drum is described below. A surface of the photoconductive drum is uniformly charged at a predetermined electrical potential by a charging device. A light ray is emitted to the charged surface of the photoconductive drum from an exposing device, such as LED, so that the electrical potential at specified portions lowers to form a static latent image of an original image on the surface. The static latent image is developed by a developing device to produce a toner image.

A tandem type color image forming apparatus for forming a color image, for example, is provided with image forming sections respectively correlating to colors of yellow, cyan, magenta, and black. Toner images formed on the photoconductive drums of the respective image forming sections are superimposedly transferred in series to an intermediate endless transfer belt so that a color image is formed on the intermediate transfer belt. Thereafter, the aforementioned color image is transferred by a second transferring mechanism to a sheet material, such as a paper sheet.

In such image forming process, various improvements have been implemented in order to enhance the image quality of the formed image. Particularly, it is an important technical issue in the enhancement of the image quality to improve the color registration performance by correcting a concentration of toner particles to be transferred or suppressing an occurrence of color slipping.

In order to solve such technical issue, the below mentioned processes are designed and implemented to correct the toner concentration or to improve the color registration performance. A predetermined pattern image is formed on the intermediate transfer belt by each of the image forming sections. The pattern image is detected and measured by an optical detector. Based on the measurement result, various feedbacks or corrections are given in the image forming process.

Meanwhile, regarding the intermediate transfer belt, a surface thereof is contaminated or deteriorated due to wear as the image forming process is repeatedly performed. Due to this, the quality of a formed image decreases gradually to cause a letter dropping or a lowering of reproduction of a thin line in comparison with an initial state where the belt has not been used.

In such case, in order to prevent the deterioration of an image, it is general to perform a recover operation, such as a cleaning, in the case where the deterioration of the image quality is caused by contamination of the surface of the belt, or to replace the intermediate transfer belt in the case where the deterioration is caused by wear deterioration of the surface of the belt.

It is difficult to check a timing of the cleaning or the replacement of the intermediate transfer belt from an outside. There has been known that a scarring or a contamination on the surface of the intermediate transfer belt is detected by an optical detector used for a correction of the toner concentration to determine the timing of the cleaning or the replacement of the intermediate transfer belt, and the timing is displayed on a display panel and the like as a message or the recover operation of the surface is performed (See Japanese Unexamined Patent Publication No. 2003-241472, or No. 2003-302878, for example).

However, the contamination or the deterioration of the surface of the intermediate transfer belt increases gradually from the initial condition. Along with this, the image quality of a formed image decreases. Accordingly, even if the deterioration condition of the intermediate transfer belt is set at a proper level and the replacement or the cleaning of the intermediate transfer belt is performed when the belt is detected to reach the set deterioration condition based on an obtained result from a detector, the belt has been subjected to some deterioration before detecting the set condition.

It is best preferable that the image formation can be stably performed without deterioration until the cleaning or the replacement of the intermediate transfer belt is done. Further, if a consumable intermediate transfer belt can be put into use longer, a high economical performance is assured.

SUMMARY OF THE INVENTION

An object of the present invention is to provide an image forming apparatus that can assure an appropriate image formation even if a surface of a transfer member is changed or deteriorated by contamination or scarring, and has a high economical performance owing to a prolonged operative life.

In order to achieve the object, an image forming apparatus according to an aspect of the present invention comprises: an image forming section for forming a plurality of toner images on a plurality of image bearing members respectively by an electrographic system; an endless belt to which the plurality of toner images are to be superimposedly transferred from the plurality of image bearing members, the endless belt being arranged close to the image forming section; a driving roller which the endless belt is placed on and is adapted to drive the endless belt; a driven roller which the endless belt is placed on; a detector for detecting a surface condition of the endless belt; and a controller for controlling at least one of the surface speed of the image bearing member and the moving speed of the endless belt in accordance with an output from the detector.

DETAILED DESCRIPTION OF THE PREFERRED EMBODIMENTS

Figure 1:
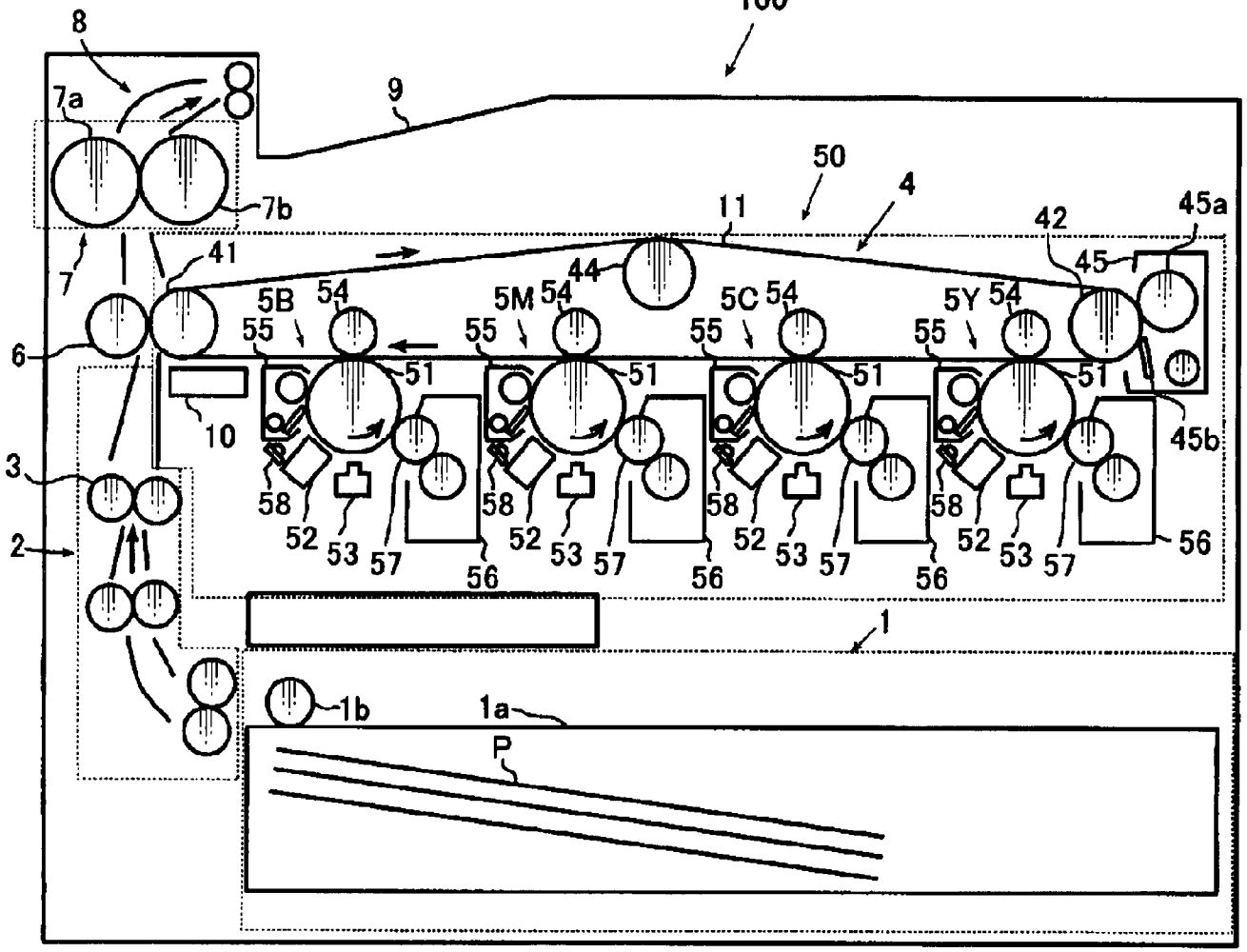
FIG. 1 is a cross sectional view showing a schematic structure of a tandem type color printer according to an embodiment of the present invention.

Hereinafter, an image forming apparatus according to an embodiment of the present invention is described referring to FIGS. 1 to 7. The image forming apparatus is a tandem type color printer 100. First, referring to FIG. 1, an image forming process is described, while describing an outline of a structure of the tandem color image forming apparatus. FIG. 1 is a vertical sectional view showing a schematic structure of the printer 100.

Figure 2:
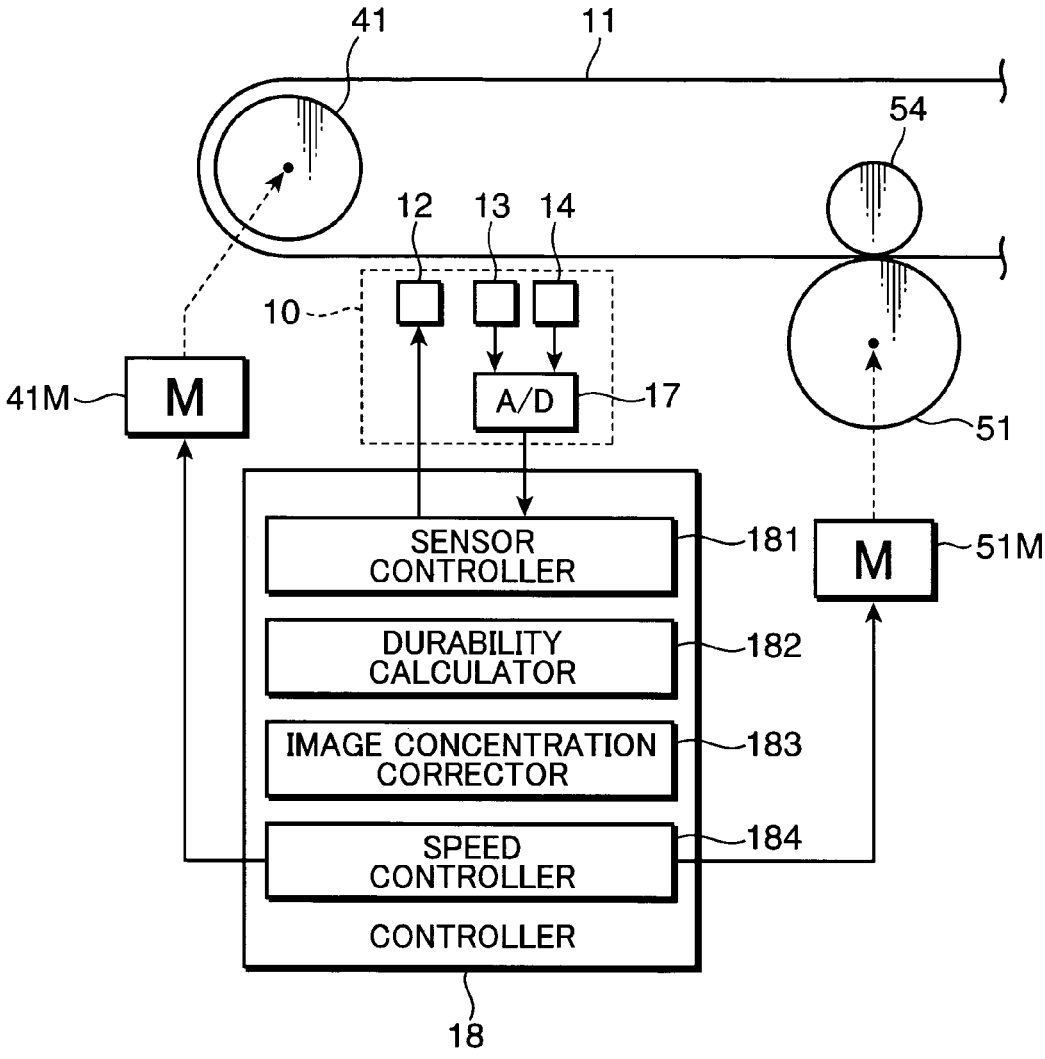
FIG. 2 is a block diagram showing an electrical structure of a main part of the printer.

The printer 100 includes a sheet supplying section 1, a vertical conveying passage 2, a pair of registration rollers 3, a belt transferring section 4, an image forming section 50, a second transferring section 6, a fixing section 7, a discharging passage 8, a discharge tray 9, an optical detecting unit 10, and a controller 18 (FIG. 2). The image forming section 50 includes four image forming mechanisms having a first image forming mechanism 5B, a second image forming mechanism 5M, a third image forming mechanism 5C, and fourth image forming mechanism 5Y.

The printer 100 carries out the image forming process as described below. A sheet P is conveyed by a pickup roller 1*b* from the sheet cassette 1*a* of the sheet supplying section 1 to the vertical conveying passage 2 to be further conveyed to the second transferring section 6 via the pair of the registration rollers 3.

In the image forming section 50, an intermediate transfer belt 11 served as an endless belt is driven in a direction indicated by arrows. On the intermediate transfer belt 11, yellow, cyan, magenta, and black toner images formed on respective photoconductive drums 51 served as image bearing members are superimposedly transferred sequentially in the image forming mechanisms 5Y, 5C, 5M, and 5B.

The color image formed in the image forming section 50 is secondly transferred from the intermediate transfer belt 11 by the second transfer section 6 to the sheet P fed from the sheet supplying cassette 1*a*. Thus, a color image is formed on the sheet P.

Thereafter, the sheet P to which the color image is not yet fixed is separated from the intermediate transfer belt 11, and conveyed to the fixing section 7. The sheet P is given a heat necessary to fix the color image in a nip portion defined by the fixing roller 7*a* and the pressing roller 7*b* pressedly contacting each other. Thus, the color image is fixed on the sheet P. After the fixing process, the sheet P is discharged via the discharging passage 8 to the discharge tray 9. It should be noted that the fixing roller 7*a* is provided with a heater (un-illustrated) therein. The heater is controlled to generate the heat for a predetermined temperature necessary to the fixing process.

Next, the image forming section 50 which is a main component of the printer 100 is described in detail. The image forming section 50 includes a belt transfer section 4, the image forming mechanisms 5B, 5M, 5C, and 5Y provided with developing devices 56 respectively, and an intermediate transfer cleaning unit 45.

As shown in FIG. 1, the belt transfer section 4 includes a driving roller 41, a driven roller 42, and the intermediate transfer belt 11 being endless and wound around these two rollers. The intermediate transfer belt 11 keeps an appropriate tension by a tension roller 44. Under this condition, the driving roller 41 receives a driving force from a driving motor 41M (FIG. 2) to be driven to keep the surface speed at an outer surface of the photoconductive drum 51 in each of the image forming mechanisms and the moving speed of the intermediate transfer belt 11 in the belt transfer section 4 the same constant speed.

The first to fourth image forming mechanisms 5B, 5M, 5C, and 5Y are arranged side under the belt transfer section 4. The image forming sections are arranged in the order of yellow (Y), cyan (C), magenta (M), and black (B) from an upstream of the sheet conveying direction, and provided image forming units having an identical construction. Thus, the same references are given to the portions having the same construction in the first to the fourth image forming mechanisms SB, SM, SC, and SY. In the following descriptions regarding the first to fourth image forming mechanisms 5B, 5M, 5C, and 5Y, the identifying references of "B", "M", "C", and "Y", are omitted except for the case where a specific description is required, and the first to fourth image forming mechanisms 5B, 5M, 5G, and 5Y are described with simply being denoted as an image forming mechanism 5.

The image forming mechanism 5 includes the photoconductive drum 51, a main charging device 52, an exposing device 53, a first transferring member (a transferring roller) 54, a cleaning device 55, and a developing device 56. These devices are mounted in a housing made of resin and the like to form one unit, and the unit is mounted in an apparatus main body.

An amorphous silicon drum is used for the photoconductive drum 51. The main charging device 52 charges the photoconductive drum 51 in such a manner that the developing area has a predetermined dark electrical potential. The exposing device 53 irradiates a light beam to the charged peripheral surface of the photoconductive drum 51 in accordance with image information to form an electrostatic latent image on the peripheral surface of the photoconductive drum 51. Though a LPH (Led Print Head) is used as the exposing device 53 in the present embodiment, a LSU (Laser Scanning Unit) may be substituted for the LPH.

Further, the photoconductive drum 51 is rotated by a driving mechanism 51M (FIG. 2), and the rotational speed of the photoconductive drum 51 is controlled by a controller 18, such as a microcomputer and the like. In other words, the photoconductive drum 51 is so controlled to rotate at an appropriate rotational speed calculated from a result obtained by a calculation in accordance with an output of the optical detecting unit 10 which detects a surface condition of the intermediate transfer belt 11.

In the developing device 56, toner particles supplied from a toner tank (un-illustrated) are applied to a surface of a developing roller 57, and toner particles are supplied from the developing roller 57 to the electrostatic latent image formed on the peripheral surface of the photoconductive drum 51 to thereby develop a toner image on the photoconductive drum 51.

For example, the photoconductive drum 51 is charged with an electrical potential of +300V. A developing bias is +200V, and an electrical potential after being exposed is +20V. A difference between the developing bias and the electrical potential after the exposure is a so-called contrast electrical potential. In the case of forming a black toner image, for example, the dark electrical potential corresponds to a white portion in the image, the electrical potential after the exposure corresponds to a black portion in the image. The toner image formed by developing the electrostatic latent image formed as above is transferred to the surface of the intermediate transfer belt 11 in the belt transfer section 4 in the transfer nip between the peripheral surface of the photoconductive drum and the first transfer member 54. The first transfer member 54 is served as a transferring roller. A transferring bias having another polarity to the surface potential of the photoconductive drum 51 is set in a range of −100 to −1000V, and applied to the first transferring member 54 in order to transfer the toner image formed on the photoconductive drum 51 to the intermediate transfer belt.

The cleaning device 55 removes toner particles which have not been transferred and remain on the photoconductive drum 51. Following this, a neutralization lump 58 removes the remaining electricity on the photoconductive drum 51 in order to lower the remaining electrical potential on the surface of the photoconductive drum 51, and neutralize the electrical potential. Thus, the photoconductive drum 51 is prepared for a next process. The most appropriate value of the electrical potential can be selected in accordance with a characteristic of the photoconductive drum 51, a characteristic of toner particles, an environment, and the like. The printer 100 is operable to form a color image in accordance with the above-mentioned processes of the image forming mechanism 5 by developing images respectively corresponding to black, magenta, cyan, and yellow on the photoconductive drum 51 in the respective first to fourth image forming mechanisms 5B, 5M, 5C, and 5Y, and superimposedly transferring the images repeatedly in series to the intermediate transfer belt 11 without slipping out.

The intermediate transfer cleaning unit 45 includes an intermediate transfer cleaning roller 45*a* and an intermediate transfer cleaning blade 45*b*. The intermediate transfer cleaning roller 45*a* comes into pressed contact with the intermediate transfer belt 11 and is rotated in the same direction as the moving direction of the intermediate transfer belt 11. The intermediate transfer cleaning blade 45*b* is operable to scratch the remaining toner particles from the intermediate transfer belt 11 by contacting the intermediate transfer belt 11 from a downstream of the intermediate transfer cleaning roller 45*a* in the moving direction of the intermediate transfer belt 11.

The optical detecting unit 10 includes a reflective sensor. The optical detecting unit 10 is used simultaneously to correct the rotational speed of the photoconductive drum 51 and to correct an image concentration by calculating a concentration of toner particles to be transferred to the intermediate transfer belt 11.

As shown in FIG. 1, the optical detecting unit 10 is placed on the furthest downstream of the respective image forming mechanisms 5 in a belt moving direction in an underside of the intermediate transfer belt 11, and in the vicinity of a position in short of the driving roller 41 in the intermediate transfer belt 11. The optical detecting unit 10 detects a surface condition of the intermediate transfer belt 11, e.g., the adhering condition of toner particles transferred to the intermediate transfer belt 11 from the respective image forming mechanisms 5 without contacting the intermediate transfer belt 11.

Next, respective electrical structures of the optical detecting unit 10 and the controller 18 are described referring to a block diagram as shown in FIG. 2. The optical detecting unit 10 includes a light emitting element 12 (LED, for example) for emitting a measurement light to the surface of the intermediate transfer belt 11, a first light receiving element 14 and a second light receiving element 13 for receiving reflection light reflected on the intermediate transfer belt 11, and an A/D converter for converting an output of the light receiving elements 13 and 14 from analogue to digital.

The controller 18 is provided with a sensor controller 181, a durability calculator 182, an image concentration corrector 183, and a speed controller 184.

The sensor controller 181 controls the light emitting element 12 of the optical detecting unit 10 to emit light at a predetermined timing so as to synchronizedly obtain an output signal from the first and second light receiving elements 14 and 13 through the A/D converter 17.

The durability calculator 182 (a first calculator) calculates a parameter value (a later described "a durability X") correlated with a surface condition of the intermediate transfer belt 11 based on a measurement output value obtained from the optical detecting unit 10.

The image concentration corrector 183 (a third calculator) calculates a concentration of toner particles on the intermediate transfer belt 11 based on the measurement output of the optical detecting unit 10, and calculates a correction amount with respect to a predetermined image forming condition based on the obtained toner concentration. When calculating the toner concentration, the image concentration corrector 183 controls to form a measurement toner image as a pattern image for every color and every concentration on the intermediate transfer belt 11, after the image forming process is performed for a predetermined number of sheets.

The speed calculator 184 (a second calculator) controls driving conditions of a driving motor 41M and a driving mechanism 51M of the driving roller 41 to control the moving speed of the intermediate transfer belt 11 and/or the rotational speed of the photoconductive drum 51.

Figure 3:
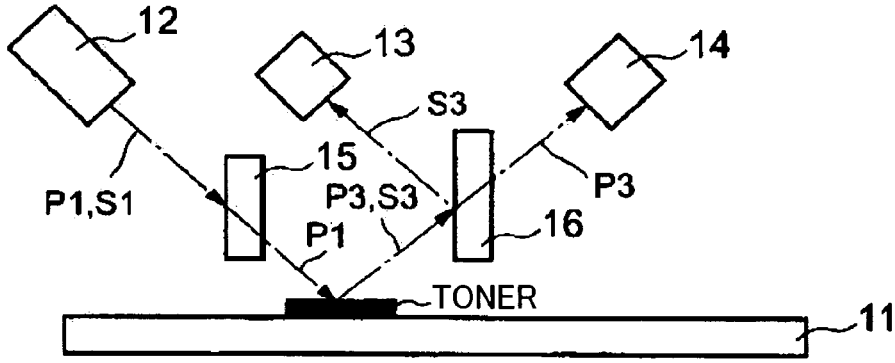
FIG. 3 is a schematic diagram showing a construction of an optical detector, and a detection under the condition where an appropriate amount of toner particles adhere to an intermediate transfer belt.
Figure 4:
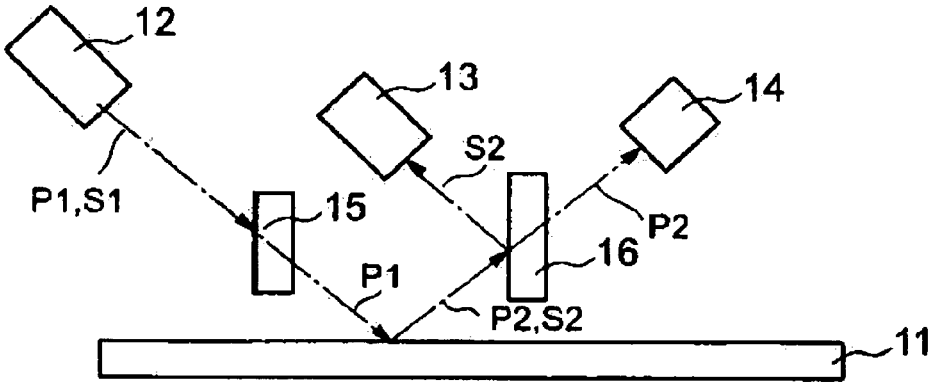
FIG. 4 is a schematic diagram showing a detection by an optical detector under the condition where no toner particles adhere to the intermediate transfer belt.
Figure 5:
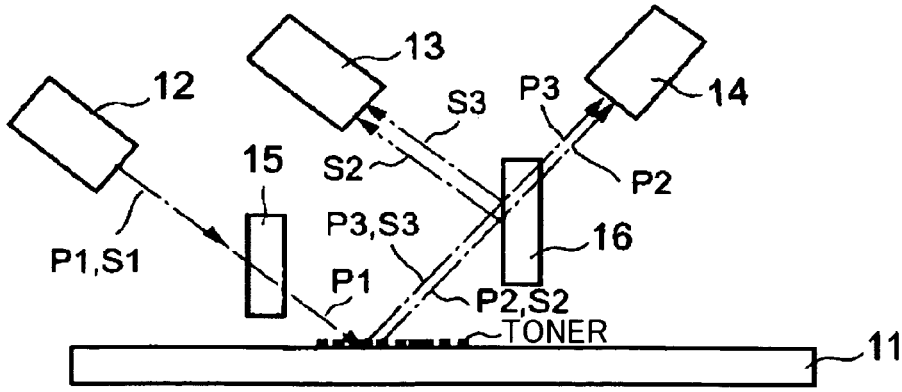
FIG. 5 is a schematic diagram showing a detection by the optical detector under the condition where toner particles unproperly adhere to the intermediate transfer belt.
Figure 6:
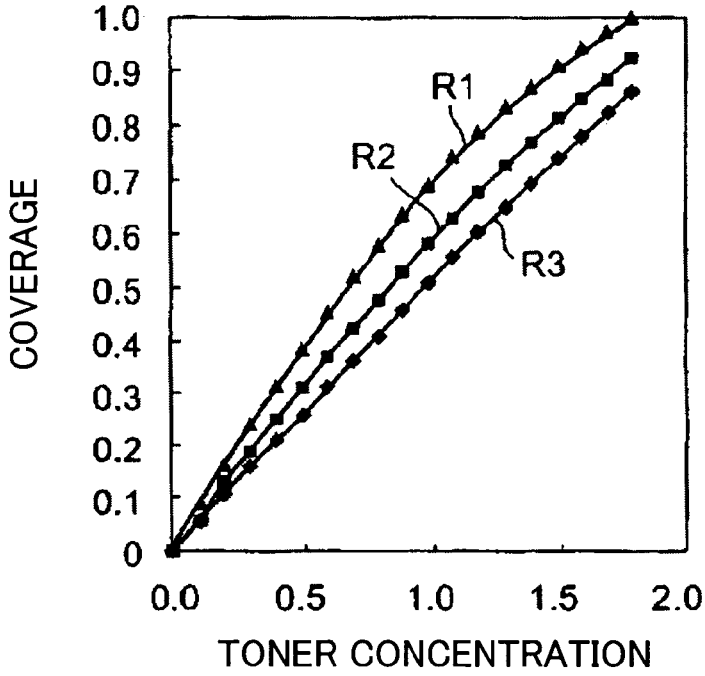
FIG. 6 is a graph showing a relation between a coverage factor calculated by the optical detector and an actual toner concentration.
Figure 7:
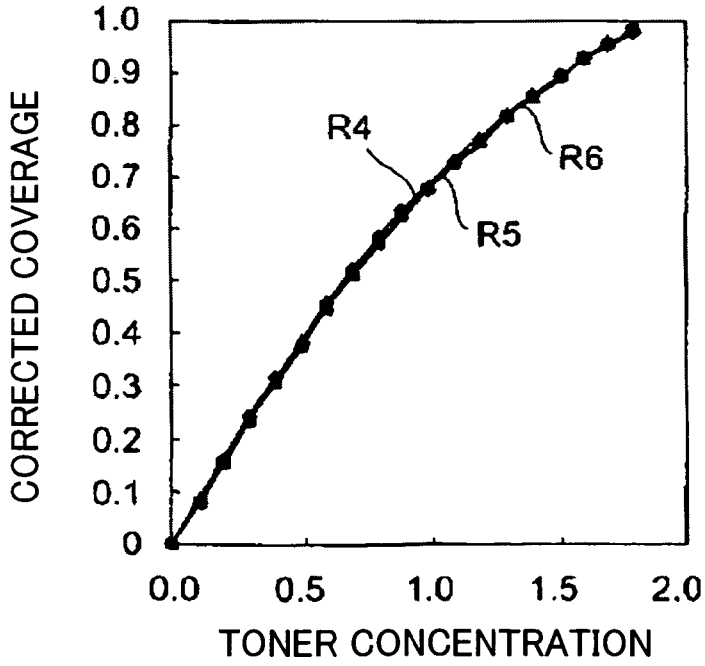
FIG. 7 is a graph showing a relation between a corrected coverage factor calculated based on a durability and an actual toner concentration.

Hereinafter, a construction and an operation of the optical detecting unit 10 for detecting a surface condition of the intermediate transfer belt 11 are described in detail, referring to FIGS. 3 to 7. FIG. 3 is a schematic diagram showing a structure of the optical detecting unit 10, and a detection by the optical detecting unit 10 under the condition where an appropriate amount of toner particles adhere to the intermediate transfer belt 11. FIG. 4 is a schematic diagram showing a detection by the optical detecting unit 10 under the condition where no toner particles adhere to the intermediate transfer belt 11. FIG. 5 is a schematic diagram showing a detection by the optical detecting unit 10 under the condition where toner particles unproperly adhere to the intermediate transfer belt 11. FIG. 6 is a graph showing a relation between a coverage factor calculated by the optical detecting unit 10 and an actual toner concentration. FIG. 7 is a graph showing a relation between a corrected coverage factor corrected based on the durability and an actual toner concentration.

In the image concentration correction, a toner patch is formed on the intermediate transfer belt 11 after the image forming process is performed for the predetermined number of sheets. A toner concentration of the toner patch is calculated to control the image forming condition, such as a developing bias, correctly in accordance with the calculated toner concentration.

At this time, the optical detecting unit 10 calculates a concentration of the toner patch on the intermediate transfer belt 11. As shown in FIG. 3, the optical detecting unit 10 includes a polarization filter 15 and a polarizing splitting prism 16 in addition to the light emitting element 12 and the first and second light receiving elements 14 and 13. The polarization filter 15 is disposed between the light emitting element 12 and the intermediate transfer belt 11 to allow only P-polarized light to pass therethrough.

Meanwhile, the polarizing splitting prism 16 is mounted between the first light receiving element 14 and the intermediate transfer belt 11. The polarizing splitting prism 16 allows the P-polarized light to pass therethrough, and transmits the light to the first light receiving element 14, while reflecting S-polarized light which is to be transmitted to the second light receiving element 13. The light emitting element 12 is inclined at a predetermined angle to the surface of the intermediate transfer belt 11.

In the case where the appropriate amount of toner particles are transferred to the intermediate transfer belt 11, when a measurement light ray is emitted from the light emitting element 12 to the intermediate transfer belt 11, a light ray S1 is cut by the P-polarization filter 15 among the measurement light rays including a P-polarized light ray P1 and the S-polarized light ray S1. All the P-polarized light rays P1 let out from the polarization filter 15 to the intermediate transfer belt 11 are reflected from toner particles. More specifically, in the case where the appropriate amount of toner particles are transferred on the intermediate transfer belt 11, the light ray P1 do not reach the surface of the intermediate transfer belt 11. Consequently, the light ray P1 are reflected from toner particles.

The light rays reflected from the toner particle include P-polarized light rays and S-polarized light, which are respectively denoted as P3 and S3. The polarizing splitting prism 16 is disposed in an optical path of the light rays which are reflected from the intermediate transfer belt 11 at an symmetrical angle of the impinging light rays with respect to a normal plane to the intermediate transfer belt 11 to split the light rays into P-polarized light rays and S-polarized light rays. As mentioned above, the reflected light rays are split by the polarizing splitting prism 16 into P-polarized light rays P3 and S-polarized light rays S3. The light rays P3 are sent to the first light receiving element 14, and the S-polarized light rays S3 are sent to the second light receiving element 13.

The first and second light receiving elements 14 and 13 photoelectrically convert the received light rays to output first and second output signals. The first and second output signals are analogue-digitally converted by the A/D converter 17, and then inputted to the controller 18.

The controller 18 adjusts the respective output levels (gain) of the first and second light receiving elements 14 and 13 to thereby equalize the levels of the first and second output signals in the case where a sufficient amount of toner particles adhere to the intermediate transfer belt 11. In other words, in the case where an appropriate amount of toner particles adhere to the intermediate transfer belt 11 (toner particles are uniformly adhered to the intermediate transfer belt 11), the levels of the first and the second output signals equal with each other. Here, Po and So are given to respective output dark voltages after adjusting the output levels of the first and the second right receiving elements.

As shown in FIG. 4, in the case where no toner image is formed on the intermediate transfer belt 11 (any toner image is not transferred to the intermediate transfer belt 11), measurement light rays are emitted from the light emitting element 12 to the intermediate transfer belt 11, and the measurement light rays including P-polarized light rays P1 and S-polarized light rays S1 are polarized by the P polarization filter 15, and the light rays S1 are cut. Accordingly, only the light rays P1 reach the surface of the intermediate transfer belt 11. The light rays reflected from the surface of the intermediate transfer belt 11 includes P-polarized light rays and S-polarized light rays depending on a surface condition of the intermediate transfer belt 11, e.g., a surface roughness.

In this case, the light rays reflected from the intermediate transfer belt 11 include P-polarized light rays and S-polarized light rays, which are respectively denoted as P2 and S2. The reflected light is split by the polarizing splitting prism 16 into light rays P2, which are P-polarized light rays, and light rays S2, which are S-polarized light rays. The second light receiving element 13 receives S-polarized light rays S2, the first light receiving element 14 receives P-polarized light rays P2.

The first and second light receiving elements 14 and 13 photoelectrically convert the received light rays (P2 and S2) to output first and second output signals respectively. The first and second output signals are analogue-digitally converted by the A/D converter 17, and inputted to the controller 18. In the case where no toner particles adhere to the intermediate transfer belt 11, the controller 18 sets first and second background voltages Pg and Sg as the first and second output signals, and sets the (Pg−Po)−(Sg−So) as a reference value. The output levels of the first and second light receiving elements 14 and 13 are adjusted as mentioned above, and a concentration of the toner particles on the intermediate transfer belt 11 is calculated after the reference value is set.

Further, as shown in FIG. 5, in the case where a toner patch having a smaller amount of toner particles than the appropriate amount is formed on the intermediate transfer belt 11, S-polarized light rays S1 of measurement light rays including P-polarized light rays P1 and S-polarized light rays S1 are cut by the P polarization filter 15. Consequently, the light rays P1 impinge toner particles. However, since the amount of toner particles are not proper, some of the light rays P1 to the toner particles are reflected from the toner particles, and the other light rays are reflected from the surface of the intermediate transfer belt 11.

More specifically, the light reflected from the surface of the intermediate transfer belt 11 include P-polarized light rays P2 and S-polarized light rays S2. The light rays P2 and S2 are split by the polarizing splitting prism 16, and the P-polarized light rays P2 are received by the first light receiving element 14, and the S-polarized light rays S2 are received by the second light receiving element 13.

Similarly, the light rays reflected from the toner particles are split by the polarizing splitting prism 16. The P-polarized light rays P3 are sent to the first light receiving element 14, and the S-polarized light rays S3 are sent to the light receiving element 13.

As mentioned above, the first and second light receiving elements 14 and 13 photoelectrically convert the received light rays, and output first and second output signals. The first and second output signals are analogue-digitally converted as first and second measurement signals by the A/D converter 17, and inputted to the controller 18. Indicating the first and second measurement signals by S and P respectively, the image concentration corrector 183 of the controller 18 calculates (P−Po)−(S−So) to obtain a measurement output value to correct an measured output value in accordance with the above-mentioned reference value. Specifically, the image concentration corrector 183 calculates ((P−Po)−(S−So))/((Pg−Po)−(Sg−So)) to obtain a corrected value, and obtains a corrected output value shown below as a coverage:

$$\text{Coverage}=1-((P-Po)-(S-So))/((Pg-Po)-(Sg-So))$$

Meanwhile, in FIG. 6 showing a relationship between a coverage and an actual toner concentration, a curved line R1 indicates a relationship between a coverage and a toner concentration when the intermediate transfer belt 11 is not yet placed into use, a curved line R2 indicates a relationship between a coverage and a toner concentration after the intermediate transfer belt 11 has been used, and a curved line R3 indicates a relationship between a coverage and a toner concentration after the intermediate transfer belt 11 has been further used. These three curved lines show a fact that the relationship between a coverage and a toner concentration varies as the used time of the intermediate transfer belt 11 changes.

However, the image concentration control cannot be carried out with such coverage, since the surface condition of the intermediate transfer belt 11 varies and the relationship between a coverage and a toner concentration varies due to deteriorations of the surface of the belt, for example, being blanched, worn, blemished, or tainted as the used time of the intermediate transfer belt 11 increases.

In view of the above, the durability X correlated with a variation in the surface condition of the intermediate transfer belt 11 is defined as follows. FIG. 6 shows that the durability X is correlated with the variation of the curved lines R1 and R2 (In FIG. 6, the durability X=0.223 in the curved line R1, the durability X=0.192 in the curved line R2, and the durability X=0.149 in the curved line R3, and the value of the durability X decreases as the used time of the intermediate transfer belt 11 increases).

$$X=A\times(1-(Sg-So)/(Pg-Po))$$

Wherein A denotes a constant number which is defined by the equation of (Pg−Po)−(Sg−So) when (Pg−Po) is A. In the case where the intermediate transfer belt 11 has a surface resistance value of $10^{10}$ Ω/□, a surface layer of PTFE, an intermediate layer of NBR rubber, and a lower layer of PI, A is 0.3. The durability calculator 182 calculates the durability X which is a parameter value correlated with the surface condition of the intermediate transfer belt 11 in accordance with the above equation.

A coverage corrected by using the above mentioned durability X is expressed as follows:

$$\text{Corrected Coverage}=B\times(1-((P-Po)-(S-So))/((Pg-Po)-(Sg-So)))$$

It should be noted that in the above equation, B denotes a corrected amount when X is used as a parameter.

FIG. 7 shows a relationship between a corrected coverage calculated in the above-mentioned way and an actual toner concentration. More particularly, the lines R4-R6 in FIG. 7 correspond respectively to the curved lines R1-R3 in FIG. 6. Thus, as described above, the curved line R4 indicates a relationship between a corrected coverage and a toner concentration when the intermediate transfer belt 11 is not yet placed into use. The curved line R5 indicates a relationship between the corrected coverage and the toner concentration after the intermediate transfer belt has been used, and the curved line R6 indicates a relationship between a corrected coverage and a toner concentration after the intermediate transfer belt 11 has been further used. As shown in FIG. 7, in the case of using the corrected coverage, even if the durability X varies, the relationship between a corrected coverage and a actual toner concentration does not substantially vary. Accordingly, the toner concentration can be accurately calculated by using the corrected coverage or a correction value which is obtained by adding a further correction to the corrected coverage, with the result that the correction control of the image formation can be carried out assuredly. The image concentration corrector 183 controls the developing bias, for example, by using such corrected coverage.

Next, detailed description is made about the transferring process where a surface condition of the intermediate transfer belt 11 is detected by the optical detecting unit 10 to change the rotational driving speed of the photoconductive drum 51 (correction of the rotational speed of the photoconductive drum 51) based on the output of the detector, and toner particles are transferred to the intermediate transfer belt 11.

The toner image developed on the photoconductive drum 51 is transferred to the surface of the intermediate transfer belt 11 at the transfer nip portion defined by the photoconductive drum 51 and the transferring roller 54 pressedly contacting with each other.

First, causes of image defections are briefly described. Image defections are caused by wear and deterioration of the surface of the intermediate transfer belt 11, or adhesion of dirts to the surface, for example.

The intermediate transfer belt 11 has a surface having a high friction coefficient when the intermediate transfer belt 11 is in an initial state that is almost bland-new condition soon after being replaced, that is, a high friction coefficient state. As the transfer process of toner particles to the surface of the belt is repeatedly performed, the deterioration of the surface of the belt increases, and the friction coefficient of the surface of the belt tends to decrease, that is, a low friction coefficient state.

Therefore, when the surface of the intermediate transfer belt 11 is in the high friction coefficient state in an initial phase, even if respective tangent or linear speeds of the photoconductive drum 51 and the intermediate transfer belt 11 are the same as each other at the transfer nip portion defined by the both, the sufficient high transferring performance can be obtained. More specifically, toner particles having positive charge and adhered to the surface of the photoconductive drum 51 are transferred to the intermediate transfer belt 11 from the photoconductive drum 51 by an attraction effect owing to the bias potential of the transferring roller 54 having a negative charge and a large frictional force of the surface of the intermediate transfer belt 11 in the transfer nip portion. Therefore, the high transferring performance can be obtained.

On the other hand, in the case when the friction coefficient of the surface of the intermediate transfer belt 11 decreases due to the deteriorations of the surface of the belt, the frictional force necessary to transfer toner particles cannot be obtained between the photoconductive drum 51 and the intermediate transfer belt 11, therefore toner particles are not peeled off from the surface of the photoconductive drum 51. Thus, necessary toner particles are not to be transferred to the intermediate transfer belt 11.

In this case, it is preferable that an appropriate speed difference is maintained between the surface speed of the photoconductive drum 51 and the moving speed of the intermediate transfer belt 11 in accordance with a surface condition of the intermediate transfer belt 11 in the transfer nip portion, such as the friction coefficient of the surface. A slight friction is generated by a speed difference between the surface of the photoconductive drum 51 and the surface of the intermediate transfer belt 11 in the transfer nip portion. This accelerates the peeling off of toner particles from the photoconductive drum 51, and the adhesive force of toner particles decreases. Accordingly, the necessary transferring performance can be obtained even when the surface of the intermediate transfer belt 11 has a decreased friction coefficient.

Further, the required speed difference between the surface of the photoconductive drum 51 and the surface of the intermediate transfer belt 11 in the transfer nip portion varies in accordance with the surface condition, such as the friction coefficient of the surface of the intermediate transfer belt 11. For example, in the case where the speed difference between the photoconductive drum 51 and the intermediate transfer belt 11 in the transfer nip portion is great and the surface of the intermediate transfer belt 11 has a high friction coefficient, a stick-slip is likely to occur between the photoconductive drum 51 and the intermediate transfer belt 11. For this reason, the transferring position between the photoconductive drum 51 and the intermediate transfer belt 11 is not kept appropriately, thereby decreasing the color registration performance.

On the other hand, in the case where the speed difference between the photoconductive drum 51 and the intermediate transfer belt 11 in the transfer nip portion is small and the surface of the intermediate transfer belt 11 has a low friction coefficient, toner particles adhering to the surface of the photoconductive drum 51 are not easily peeled off from the surface. Under this condition, a stress is given to the unpeeled toner particles by the transferring roller 54 via the intermediate transfer belt 11. This makes toner particles further tend to adhere to the surface of the photoconductive drum 51 so that toner particles adhering to the surface of the drum are not transferred to the belt, causing the image deterioration, such as a letter dropping, decreased reproductivity of a thin line.

Accordingly, in order to obtain an appropriate transferring performance, it is important to appropriately adjust the speed difference between the surface of the photoconductive drum 51 and the surface of the intermediate transfer belt 11 in the transfer nip portion in accordance with the surface condition, such as the friction coefficient of the surface of the intermediate transfer belt 11.

As mentioned above, the durability X calculated by using the optical detecting unit 10 is a parameter which is calculated based on the surface condition such as a roughness of the surface of the intermediate transfer belt 11. Further, the durability X tends to decrease as the used time of the intermediate transfer belt 11 increases. Since the roughness of the surface of the intermediate transfer belt 11 is highly correlated with the friction coefficient, the durability X is highly correlated with the friction coefficient of the surface of the intermediate transfer belt 11. Accordingly, the rotational driving speed of the photoconductive drum 51 is appropriately changed in accordance with the durability X, resulting in obtaining the same effect as the case where the speed difference between the surface of the photoconductive drum 51 and the surface of the intermediate transfer belt 11 is appropriately changed. Based on such knowledge, the speed controller 184 controls the rotational speed of the photoconductive drum 51 (or the moving speed of the intermediate transfer belt 11) in accordance with the durability X obtained by the durability calculator 182.

Table 1 shows preset speed ratio values to assure the appropriate transferring performance, that is, Va (=(Vb−Vd)/Vd×100) based on the speed difference between the surface speed Vd of the photoconductive drum 51 and the surface moving speed Vb of the intermediate transfer belt 11 based on the durability X obtained by the result of an experiment.

TABLE 1

| Durability X | Speed Ratio Va |
|---|---|
| Not less than 0.25 | 0.1 |
| 0.23 to 0.25 | 0.2 |
| 0.21 to 0.23 | 0.3 |
| 0.19 to 0.21 | 0.4 |
| 0.17 to 0.19 | 0.5 |
| 0.15 to 0.17 | 0.6 |
| 0.15 or below | 0.7 |

In the image forming process, for example, the speed controller 184 makes the optical detecting unit 10 read the surface of the intermediate transfer belt 11 through the sensor controller 181 at a predetermined timing, such as, at a start-up of the printer 100, after the image formation, or during warming-up, or at regular intervals, under the condition where toner particles are not transferred to the intermediate transfer belt 11. The durability calculator 182 calculates a durability X from the value obtained in the above-mentioned way. The speed controller 184 determines a speed ratio between the photoconductive drum 51 and the intermediate transfer belt 11 in the transfer nip portion in accordance with the value shown in Table 1 to adjust the driving amount of the driving mechanism 51M to thereby control the rotational driving speed of the photoconductive drum 51.

As mentioned above, the durability X having the high correlation with the friction coefficient is greatest when the intermediate transfer belt 11 has not been used yet, that is, the high friction coefficient state, and decreases as the used time of the intermediate transfer belt 11 increases, that is, the low friction coefficient state. According to Table 1, an appropriate speed ratio based on the durability X becomes greater as the durability X decreases.

When the speed difference between the photoconductive drum 51 and the intermediate transfer belt 11 is given, the moving speed of the intermediate transfer belt 11 is set to be faster than the surface speed of the photoconductive drum 51 so as to keep the tension of the intermediate transfer belt 11 from loosing. Accordingly, the intermediate transfer belt 11 is correctly and evenly driven without deflection, and displacement due to the deflection is suppressed and the toner image of each image forming mechanism is transferred to the belt accurately. Therefore, the color registration performance is improved to thereby produce an image having a high quality.

In the case of controlling the rotational speed of the photoconductive drum 51 based on the table 1, when a new intermediate transfer belt 11 is mounted and the surface of the belt has the high friction coefficient, the durability X calculated based on the optical detecting unit 10 is not less than 0.25. The speed controller 184 controls the rotational speed of the photoconductive drum 51 in the transfer nip portion to be faster than the moving speed of the intermediate transfer belt 11 by 0.1%.

Thereafter, as the used time of the intermediate transfer belt 11 further increases, the gradual deterioration of the surface of the belt causes the friction coefficient of the surface of the belt to decrease gradually. The rotational speed of the photoconductive drum 51 is corrected each time the printer 100 starts up, for example. At this time, the surface condition of the intermediate transfer belt 11 at the starting-up of the printer 100 is detected, and the rotational speed of the photoconductive drum 51 is corrected based on the output obtained from the result of the detection.

Accordingly, since the rotational speed of the photoconductive drum 51 is corrected at relatively short period intervals with respect to the gradually deteriorating surface of the intermediate transfer belt 11, the rotational speed of the photoconductive drum 51 almost always adapted to the surface condition of the intermediate transfer belt 11 is kept constant. Accordingly, in spite of the deterioration of the surface of the intermediate transfer belt 11, the transferring performance of toner particles from the photoconductive drum 51 to the intermediate transfer belt 11 can be kept appropriately. Therefore, the image having a high quality can be stably formed that has no letter dropping and excellent reproduction of a thin line until replacement of the intermediate transfer belt 11. Further, even if the intermediate transfer belt 11 deteriorates, an appropriate image quality can be maintained and the intermediate transfer belt 11 can have a longer operative life, resulting in the maintenance cost reduction.

Further, the speed difference between the photoconductive drum 51 and the intermediate transfer belt 11 in the transfer nip portion based on the durability X can be maintained by changing the rotational speed of the photoconductive drum 51 while keeping the moving speed of the intermediate transfer belt 11 in constant. Therefore, the real size reproduction performance of an image can be maintained.

As mentioned above, the correction of the rotational speed of the photoconductive drum 51 according to the present embodiment can be carried out by using the optical detecting unit 10 used for calculating a concentration of toner particles applied to the intermediate transfer belt 11. Accordingly, in the case where an optical detecting unit for calculating a toner concentration is previously provided, there is no need to newly mount other parts, thereby enabling to mount the optical detecting unit at a lower cost and in a smaller space. Further, a surface condition of the intermediate transfer belt 11 is detected by the optical detecting unit 10 without contact to thereby increase the flexibility of mounting, and contribute to a long operative life of the intermediate transfer belt 11 because of no possibility of damaging the belt surface.

The above-mentioned specific embodiments mainly refer to inventions having the following constructions.

An image forming apparatus comprises an image forming section for forming a plurality of toner images on a plurality of image bearing members respectively by an electrographic system; an endless belt to which the plurality of toner images are to be superimposedly transferred from the plurality of image bearing members, the endless belt being arranged close to the image forming section; a driving roller which the endless belt is placed on and is adapted to drive the endless belt; a driven roller which the endless belt is placed on; a detector for detecting a surface condition of the endless belt; and a controller for controlling at least one of the surface speed of the image bearing member and the moving speed of the endless belt in accordance with an output from the detector.

With this construction, even in the case when the capability of transferring of the toner image formed on the image bearing surface to the surface of the endless belt decreases since the surface condition of the endless belt varies due to the deterioration and the like of the surface of the endless belt to cause the friction coefficient of the surface of the endless belt to decrease for example, the controller appropriately controls the difference of the speed of the image bearing surface and the moving speed of the endless belt based on the output from the detector so as to improve the transferring performance of the toner image on the image bearing member from the surface of the endless belt. Accordingly, regardless of the surface condition of the endless belt, the high quality image can be formed stably that has no letter dropping, and excellent reproduction of a thin line. Further, even if the endless belt deteriorates, an appropriate image quality can be maintained to thereby enable the endless belt to be used longer, resulting in the maintenance cost reduction.

In the above construction, it is preferable that the controller controls the surface speed of the image bearing member while keeping the moving speed of the endless belt constant.

With this arrangement, only the surface speed of the image bearing member is controlled while keeping the moving speed of the endless belt in constant, to generate the difference between the surface speed of the image bearing surface and the moving speed of the endless belt. Accordingly, regardless of a variety of surface speeds of the image bearing member, the real size reproduction performance of an image in the image forming process can be maintained. Thus, even if the surface speed of the image bearing member is varied based on the output obtained from the detecting unit which detects a surface condition of the endless belt, other processes in the image forming process are not be influenced, thereby enabling adjustment of the speed difference very simply.

In the above construction, it is preferable that the output of the detector is associated with a friction coefficient of the surface of the endless belt and the controller increases a difference between the surface speed of the image bearing member and the moving speed of the endless belt when the friction coefficient decreases.

With this arrangement, when the friction coefficient of the transferable surface of the endless belt to which a toner image is transferred decreases to consequently lower the toner transferring performance due to contamination or deterioration of the surface of the endless belt, toner particles can be transferred appropriately by increasing the difference between the surface speed of the image bearing member and the moving speed of the endless belt to compensate for the lowered transferring performance. In other words, regardless of the surface condition of the endless belt, the image having a high quality can be stably formed that has no letter dropping and excellent reproduction of a thin line. Further, an appropriate image quality can be maintained even if the intermediate transfer belt deteriorates. Therefore, the endless belt can be used longer, assuring the high economical performance.

In the above construction, it is preferable that the detector includes an optical detecting unit.

With this arrangement, the optical detecting unit can detect a surface condition of the endless belt without contacting thereto. The optical detecting unit can carry out the detection with being uninvolved by an operation, deterioration and the like of the endless belt and with no effecting on the endless belt at all. Further, the optical detecting unit can be mounted in a place apart from the endless belt, thereby increasing the degree of flexibility for the mounting.

In this case, it is preferable that the controller carries out the speed control in accordance with a durability of the endless belt that is calculated from an output from the optical detecting unit.

The durability based on a surface roughness and the like has a high correlation with the friction coefficient of the surface of the endless belt. The determination of the difference between the surface speed of the image bearing surface and the moving speed of the endless belt provides the same effect as the setting of the speed difference in accordance with the friction coefficient of the surface of the endless belt.

For example, a surface of an unused endless belt has a high friction coefficient so that an obtainable durability increases. In this case, since the capability of transferring toner particles is high, the speed difference is set to be small. When the friction coefficient decreases due to contamination or deterioration of the surface of the endless belt, the durability becomes small. In this case, since the capability of transferring toner particles lowers, the speed difference is controlled to become large to thereby increase the capability of transferring toner particles. For this reason, regardless of a surface condition of the endless belt, the image having a high quality can be stably formed that has no letter dropping and excellent reproduction of a thin line. Further, even if the endless belt deteriorates, an appropriate image quality can be maintained, therefore, the endless belt can be used longer, resulting in the economically high performance.

Further, it is preferable that the optical detecting unit takes up a predetermined pattern image formed on the endless belt by the image bearing member for calculation of a concentration of toner particles adhering to the endless belt based on a measurement of the predetermined pattern image.

With this arrangement, the surface condition of the endless belt is detected by using the optical detecting unit to determine and display a replacement timing of the endless belt or an operation timing of recovering of the surface of the endless belt, in order to make the formed image generally have the high quality by correcting the toner concentration, preserving and improving the color registration performance. Further, the surface of the endless belt is detected by using the optical detecting unit, and the difference between the surface speed of the image bearing member and the moving speed of the endless belt is appropriately controlled in accordance with the obtained output, thereby enabling formation of the high quality image having an excellent reproduction of a thin line and no letter dropping, regardless of the surface condition of the endless belt. In other words, since the optical detecting unit is a conventionally used one, the high quality image reproduction and the long operation life of the endless belt can be easily realized at the low cost without mounting a specially provided expensive part.

In the above construction, it is preferable that the moving speed of the endless belt driven by the driving roller is higher than the surface speed of the image bearing member.

With this arrangement, in a contacting portion where the surfaces of the image bearing member and the endless belt contact each other, the surface of the endless belt slides in the moving direction with respect to the surface of the image bearing member.

Accordingly, the endless belt receives a pulling force opposite to the moving direction of the endless belt at the contacting surface due to the image bearing member lagging behind. More specifically, the endless belt receives the pulling force by the image bearing member in each image forming mechanism so that the endless belt always receives the pulling force during the operation. Therefore, no deflection occurs in the belt. Accordingly, the toner image in each image forming mechanism can be accurately transferred to the belt, thereby improving the color registration performance to realize the high quality image.

In the above construction, it is preferable that the controller includes a first calculating section for calculating a parameter value correlated with a surface condition of the endless belt based on an output from the detector, and a second calculating section for carrying out a calculation to control at least one of the surface speed of the image bearing member and the moving speed of the endless belt based on the parameter value.

In this case, it is preferable that the controller further includes a third calculating section for calculating a concentration of toner on the endless belt based on an output from the detector, and calculating a correction amount for a predetermined image forming condition based on the obtained toner concentration.

This application is based on patent application No. 2006-017622 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

an image forming section for forming a plurality of toner images on a plurality of image bearing members respectively by an electrographic system;

an endless belt to which the plurality of toner images are to be superimposedly transferred from the plurality of image bearing members, the endless belt being arranged close to the image forming section;

a driving roller which the endless belt is placed on and is adapted to drive the endless belt;

a driven roller which the endless belt is placed on;

a detector for detecting a friction condition of the surface of the endless belt; and, a controller for controlling at least one of the surface speed of the image bearing members and the moving speed of the endless belt in accordance with an output from the detector.

2. An image forming apparatus according to claim 1, wherein the controller controls the surface speed of the image bearing members while keeping the moving speed of the endless belt constant.

3. An image forming apparatus according to claim 1, wherein the detector includes an optical detecting unit.

4. An image forming apparatus according to claim 3, wherein the controller carries out the speed control in accordance with a durability of the endless belt that is calculated from an output from the optical detecting unit.

5. An image forming apparatus according to claim 1, wherein the moving speed of the endless belt driven by the driving roller is higher than the surface speed of the image bearing members.

6. An image forming apparatus according to claim 1, wherein the controller includes:

a first calculating section for calculating a parameter value correlated with a surface condition of the endless belt based on an output from the detector; and, a second calculating section for carrying out a calculation to control at least one of the surface speed of the image bearing members and the moving speed of the endless belt based on the parameter value.

7. An image forming apparatus according to claim 6, wherein the controller further includes a third calculating section for calculating a concentration of toner on the endless belt based on an output from the detector, and calculating a correction amount for a predetermined image forming condition based on the obtained toner concentration.

8. An image forming apparatus comprising:

an image forming section for forming a plurality of toner images on a plurality of image bearing members respectively by an electrographic system;

an endless belt to which the plurality of toner images are to be superimposedly transferred from the plurality of image bearing members, the endless belt being arranged close to the image forming section;

a driving roller which the endless belt is placed on and is adapted to drive the endless belt;

a driven roller which the endless belt is placed on;

a detector for detecting a surface condition of the endless belt; and, a controller for controlling the surface feed of the image bearing members in accordance with an output from the detector, wherein the output of the detector is associated with a friction coefficient of the surface of the endless belt; and, the controller increases a difference between the surface speed of the image bearing members and the moving speed of the endless belt when the friction coefficient decreases.

9. An image forming apparatus comprising:

an image forming section for forming a plurality of toner images on a plurality of image bearing members respectively by an electrographic system;

an endless belt to which the plurality of toner images are to be superimposedly transferred from the plurality of image bearing members, the endless belt being arranged close to the image forming section;

a driving roller which the endless belt is placed on and is adapted to drive the endless belt;

a driven roller which the endless belt is placed on;

a detector for detecting a surface condition of the endless belt, the detector including an optical detecting unit that takes up a predetermined pattern image formed on the endless belt by the image bearing members for calculation of a concentration of toner adhered on the endless belt based on a measurement of the predetermined pattern image; and a controller for controlling at least one of the surface speed of the image bearing members and the moving speed of the endless belt in accordance with an output from the detector.

10. An image forming apparatus comprising:

an image forming section for forming a plurality of toner images on a plurality of image bearing members respectively by an electrographic system;

an endless belt to which the plurality of toner images are to be superimposedly transferred from the plurality of image bearing members, the endless belt being arranged close to the image forming section;

a driving roller which the endless belt is placed on and is adapted to drive the endless belt;

a driven roller which the endless belt is placed on;

a detector for detecting a surface condition of the endless belt; and, a controller for controlling at least one of the surface speed of the image bearing members and the moving speed of the endless belt in accordance with an output from the detector, wherein the output of the detector is associated with a friction coefficient of the surface of the endless belt, and the controller controls the moving speed of the endless belt in accordance with the friction coefficient of the surface of the endless belt.

* * * * *